US006962202B2

(12) United States Patent
Bell et al.

(10) Patent No.: US 6,962,202 B2
(45) Date of Patent: Nov. 8, 2005

(54) CASING CONVEYED WELL PERFORATING APPARATUS AND METHOD

(75) Inventors: Matthew Robert George Bell, Houston, TX (US); Eugene Murphy, Houston, TX (US); Edward Paul Cernocky, Mandeviille, LA (US); Christopher Burres, Houston, TX (US); Aron Ekelund, Houston, TX (US); Allen Lindfors, Inyokern, CA (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/339,225

(22) Filed: Jan. 9, 2003

(65) Prior Publication Data

US 2004/0134658 A1 Jul. 15, 2004

(Under 37 CFR 1.47)

(51) Int. Cl.[7] ..... E21B 43/117; E21B 43/1185; F42B 1/02; F42B 3/02

(52) U.S. Cl. ..... 166/297; 166/55; 166/299; 175/4.55; 102/320; 102/308; 102/310; 102/476

(58) Field of Search ..... 175/2, 4.55; 166/297, 166/55, 299; 102/308, 310, 313, 319, 321, 321.1, 320, 476

(56) References Cited

U.S. PATENT DOCUMENTS

| | | | | |
|---|---|---|---|---|
| 4,234,768 A | * | 11/1980 | Boop | 200/52 R |
| 4,391,337 A | | 7/1983 | Ford et al. | 175/4.6 |
| 4,485,741 A | * | 12/1984 | Moore et al. | 102/331 |
| 4,493,260 A | * | 1/1985 | Foster | 102/307 |
| 4,496,009 A | | 1/1985 | DerMott et al. | |
| 4,538,680 A | | 9/1985 | Brieger et al. | |
| 4,576,093 A | | 3/1986 | Snyder | 102/200 |
| 4,615,268 A | | 10/1986 | Nakano et al. | 102/217 |
| 4,619,333 A | | 10/1986 | George | |
| 4,693,317 A | * | 9/1987 | Edwards et al. | 166/378 |

(Continued)

FOREIGN PATENT DOCUMENTS

| | | | |
|---|---|---|---|
| FR | 2688583 | 9/1993 | F42C/13/04 |
| JP | 5149700 | 6/1993 | F42C/15/42 |
| RU | 2001250 C1 | 10/1993 | E21B/43/117 |
| SU | 1657627 A1 | 6/1991 | E21B/43/117 |
| WO | WO 00/05774 | 2/2000 | |
| WO | WO 00/65195 | 11/2000 | |

OTHER PUBLICATIONS

Ron Baker, "A Primer of Oilwell Drilling," Fourth Edition, First Edition published 1951, Fourth Edition published 1979, pp. 59–61, 68–71, The University of Texas at Austin.

*Drilling and Bit Technology; Casing–conveyed performating tested*; Barry Rustad, et al., Feb. 2000; pp. 85–87.

*Leaving Fewer Footprints, Shell International Exploration and Production*; , Dec. 1, 2002; pp. 1–12.

Perdue, Jeanne, "Well Construction: Thinking outside the casing," Feb. 2002, pp. 1–5, Hart's E&P Net (Chemical Week Associates, New York, New York).

*Primary Examiner*—David Bagnell
*Assistant Examiner*—T Shane Bomar

(57) ABSTRACT

Disclosed is a casing conveyed perforating apparatus and method for externally perforating a wellbore casing. The perforating apparatus is attached to the outside of the casing and is conveyed along with the casing when it is inserted into the wellbore. The perforation is accomplished using two groups of charges, which are contained in protective pressure chambers. Each pressure chamber is positioned radially around the outside of the wellbore casing. The pressure chambers form longitudinally extending ribs, which conveniently serve to center the casing within the wellbore. One group of charges is aimed inward in order to perforate the casing. A second group is aimed outward in order to perforate the formation. In an alternative embodiment, only one group of bi-directional charges is provided.

14 Claims, 10 Drawing Sheets

U.S. PATENT DOCUMENTS 4,768,597 A 9/1988 Lavigne et al.
4,790,383 A 12/1988 Savage et al.
4,850,438 A 7/1989 Regalbutto
4,884,506 A 12/1989 Guerreri
4,911,251 A 3/1990 George et al.
4,917,187 A 4/1990 Burns et al.
4,924,952 A 5/1990 Schneider
4,969,525 A 11/1990 George et al.
5,031,517 A 7/1991 Yeh ..... 99/319
5,038,682 A 8/1991 Marsden ..... 102/220
5,050,672 A 9/1991 Huber et al.
5,090,321 A 2/1992 Abouav ..... 102/200
5,159,149 A 10/1992 Marsden ..... 102/217
5,279,228 A 1/1994 Ayer ..... 102/306
5,287,924 A 2/1994 Burleson et al.
5,355,957 A 10/1994 Burleson et al.
5,423,382 A 6/1995 Barton et al.
5,436,791 A 7/1995 Turano et al. ..... 361/253
5,467,823 A 11/1995 Babour et al. ..... 166/250.01
5,479,860 A 1/1996 Ellis ..... 102/313
5,513,703 A 5/1996 Mills et al. ..... 166/55.13
5,542,480 A * 8/1996 Owen et al. ..... 175/4.51
5,594,197 A * 1/1997 Lindstadt et al. ..... 102/499
5,660,232 A 8/1997 Reinhardt ..... 166/297
5,691,712 A * 11/1997 Meek et al. ..... 340/853.3
5,706,892 A 1/1998 Aeschbacher, Jr. et al. ... 166/66
5,765,641 A 6/1998 Shy et al. ..... 166/292
5,767,437 A 6/1998 Rogers ..... 102/200
5,807,302 A 9/1998 Wandel ..... 604/8
5,829,538 A 11/1998 Wesson et al. ..... 175/4.6
5,943,954 A 8/1999 Otomo ..... 101/120
6,009,947 A 1/2000 Wilson et al.
6,016,753 A * 1/2000 Glenn et al. ..... 102/307
6,082,450 A 7/2000 Snider et al.
6,085,843 A 7/2000 Edwards et al.
6,234,081 B1 5/2001 Neyer ..... 102/202.5
6,247,408 B1 6/2001 Andrejkovies et al. ..... 102/200
6,305,475 B1 * 10/2001 Carnahan ..... 166/313
6,386,288 B1 5/2002 Snider et al.
6,536,524 B1 3/2003 Snider
6,557,636 B2 5/2003 Cernocky et al. ..... 166/297
6,702,039 B2 * 3/2004 Parrott et al. ..... 175/4.6
2003/0000411 A1 1/2003 Cernocky et al. ..... 102/200
2003/0000703 A1 1/2003 Cernocky et al. ..... 166/297
2003/0001753 A1 1/2003 Cernocky et al. ..... 340/853.1

* cited by examiner

CASING CONVEYED WELL PERFORATING APPARATUS AND METHOD

CROSS-REFERENCE TO RELATED APPLICATIONS

None.

STATEMENT REGARDING FEDERALLY SPONSORED RESEARCH OR DEVELOPMENT

None.

BACKGROUND OF THE INVENTION

1. Field of the Invention

The present invention relates to a method and apparatus for perforating the walls of a wellbore and, in particular, to a method and apparatus which will provide accurate and controlled perforating of a tubular casing during the process of creating a subterranean well. More specifically, a perforating assembly is deployed along with the casing to be used for the perforation and stimulation of zones for the ultimate withdrawal of hydrocarbons therefrom or injection of fluids (liquid or gas) for the purpose of voidage replacement or stimulation of the production interval wherein said perforating assembly comprises a frame supporting a plurality of pressure chambers configured as longitudinally extending ribs which conveniently serve to centralize the casing within the wellbore.

2. Description of Related Art

Wellbores are typically drilled using a drilling string with a drill bit secured to the lower free end and then completed by positioning a casing string within the wellbore. The casing increases the integrity of the wellbore and provides a flow path between the surface and selected subterranean formations for the withdrawal or injection of fluids.

Casing strings normally comprise individual lengths of metal tubulars of large diameter. These tubulars are typically secured together by screw threads or welds. Conventionally, the casing string is cemented to the well face by circulating cement into the annulus defined between the outer surface of the casing string and the wellbore face. The casing string, once embedded in cement within the well, is then perforated to allow fluid communication between the inside and outside of the tubulars across intervals of interest. The perforations allow for the flow of treating chemicals (or substances) from the inside of the casing string into the surrounding formations in order to stimulate the production or injection of fluids. Later, the perforations are used to receive the flow of hydrocarbons from the formations so that they may be delivered through the casing string to the surface, or to allow the continued injection of fluids for reservoir management or disposal purposes.

Perforating has conventionally been performed by means of lowering a perforating gun on a carrier down inside the casing string. Once a desired depth is reached across the formation of interest and the gun secured, it is fired. The gun may have one or many charges thereon which are detonated using a firing control, which is activated from the surface via wireline or by hydraulic or mechanical means. Once activated, the charge is detonated to penetrate and thus perforate both the casing, cement, and to a short distance, the formation. This establishes the desired fluid communication between the inside of the casing and the formation. After firing, the gun is either raised and removed from the wellbore, left in place, or dropped to the bottom thereof.

Examples of the known perforating devices can be found in U.S. Pat. No. 4,538,680 to Brieger, et. al; U.S. Pat. No. 4,619,333 to George; U.S. Pat. No. 4,768,597 to Lavigne, et. al; U.S. Pat. No. 4,790,383 to Savage, et. al; U.S. Pat. No. 4,911,251 to George, et. al; U.S. Pat. No. 5,287,924 to Burleson, et. al; U.S. Pat. No. 5,423,382 to Barton, et. al; and U.S. Pat. No. 6,082,450 to Snider, et. al. These patents all disclose perforating guns that are lowered within a casing string carrying explosive charges, which are detonated to perforate the casing outwardly as described above. This technique provided the advantage of leaving the inside of the casing relatively unobstructed since debris and ragged edges would be outwardly directed by the detonations of the charges.

U.S. Pat. No. 6,386,288 issued to Snider, et. al, describes an attempt to perforate a tubular from the outside. The technique in Snider involves the use of a perforating gun separate from and exterior to the casing to be perforated as can be seen in FIGS. 1–3.

Referring to FIG. 1, the Snider perforating gun 20 may be seen positioned within wellbore 2 adjacent the exterior of casing 12. The perforating gun 20 is secured to casing 12 by metal bands (not shown), which are wrapped around both casing 12 and perforating gun 20. The perforating gun 20 is constructed of metal. An electric line 18 extends from a power source (not illustrated) at the surface 4 to ignite the perforating gun 20. Snider discloses that other suitable control systems for igniting the explosive charge(s) contained in perforating gun 20, such as hydraulic lines connected to a suitable source of pressurized hydraulic fluid (liquid or gas) or electromagnetic or acoustic signaling and corresponding receivers connected to the perforating gun assemblies for wave transmissions through the casing, soil and/or wellbore fluids, may also be used. Snider indicates that conventional means are used to secure the lines to the casing at desired intervals.

Referring to FIG. 2, the Snider perforating gun 20 has two explosive charges, 22 and 26, contained therein, which are aimed toward casing 12. Charges 22 and 26 are axially spaced apart within perforating gun 20 and which, although oriented at slightly different angles, are both aimed toward casing 12. As can best be seen in FIG. 3, upon transmission of electrical current via line 18, explosive charge 22 detonates and fires a shaped charge along path 24 creating perforations 11 and 14 in the wall of casing 12. Explosive charge 26 detonates and fires a shaped charge along path 28 creating perforations 15 and 16.

When the Snider gun is detonated, portions of the gun act in a manner similar to shrapnel to perforate the casing string. This has disadvantages. First, the resulting perforations 11, 14, 15, and 16 tend to be ragged. Especially perforations 14 and 16—the ones furthest away from the gun. This is because the perforations 14, 16 at these remote locations are created using not only the shaped charge itself, but also portions of the casing blasted from perforations 11 and 15, when the proximate perforations were created. As a result, perforations 14 and 16 will be much less precise than perforations 11 and 15.

A second disadvantage is that all of the charges in the Snider gun are fired from the same point of origin relative to the circumference of the casing. Because of this, the perforations created are significantly asymmetrical. As can be seen in FIG. 3, perforations 11 and 15 are very close together, whereas perforations 14 and 16 are far apart.

The asymmetrical nature and raggedness of the perforations will cause the well to have poor in-flow properties when the well is placed into production. Additionally, the raggedness of casing perforations 11 and 15 may occur to the extent that the ruptured inner surface of the casing could damage or even prevent passage of down-hole tools and instruments. The structural integrity of the casing string might even be compromised to a degree.

A third disadvantage inherent in the method disclosed in Snider relates to the size of the cement-filled annulus created between the outer surface of the casing 12 and the inner surface of the bore hole. See FIG. 2. This is because perforating gun 20 is unreasonably large, and thus, the profile of the wellbore and casing 12 are not concentric. Rather, the center axis of the casing 12 is offset a great deal from the center axis of the wellbore to create sufficient space that the perforating gun 20 and a flapper housing (not pictured) may be received therein. The flapper housing is disposed below the gun and is used to seal off lower zones after they have been perforated. The annular gap must be made even larger if multiple guns are to be employed at a given depth. Because this annular gap must be made larger with the Snider method, either the bore size must be made bigger, or the casing must be made smaller in diameter. Both of these solutions have disadvantages. Even a slight increase in bore size will result in significant additional drilling costs. Reducing the diameter of the casing 12, however, will diminish the conduits flow abilities. Therefore, because deploying the Snider gun requires extra space outside the casing, the user must either pay additional drilling costs or suffer the consequence of reduced conduction of processing fluids.

A fourth disadvantage is that the Snider gun assembly is constructed of metal. This is disadvantageous in that when the guns are fired, metal fragments from the perforating gun 20 will cause collateral damage thus impairing the flow performance of the perforation tunnel. This could be avoided if a less destructive material were used.

Frequently a well penetrates multiple zones of the same formation and/or a plurality of hydrocarbon bearing formations of interest. It is usually desirable to establish communication with each zone and/or formation of interest for injection and/or production of fluids. Conventionally, this has been accomplished in any one of several ways. One way is to use a single perforating gun that is conveyed by wireline or tubing into the wellbore and an explosive charge fired to perforate a zone and/or formation of interest. This procedure is then repeated for each zone to be treated and requires running a new perforating gun into the well for each zone and/or formation of interest.

One alternative is to have a single perforating gun carrying multiple explosive charges. This multiple explosive charge gun is conveyed on wireline or tubing into the well and, as the gun is positioned adjacent to each zone and/or formation of interest, selected explosive charges are fired to perforate the adjacent zone and/or formation. In another alternative embodiment, two or more perforating guns, each having at least one explosive charge, are mounted spaced apart on a single tubing, then conveyed into the well, and each gun is selectively fired when positioned opposite a zone and/or formation of interest. When the select firing method is used, and the zone and/or formation of interest are relatively thin, e.g., 15 feet or less, the perforating gun is positioned adjacent the zone of interest and only some of the shaped charges carried by the perforating gun are fired to perforate only this zone or formation. The gun is then repositioned, by means of the tubing, to another zone or formation and other shaped charges are fired to perforate this zone or formation. This procedure is repeated until all zones and/or formations are perforated, or all of the shaped explosive charges detonated, and the perforating gun is retrieved to the surface by means of the tubing.

However, the necessity of tripping in and out of the wellbore to perforate and stimulate each of multiple zones and/or formations is time consuming and expensive. In view of this, multiple zones and/or formations are often simultaneously stimulated, even though this may result in certain zones and/or formations being treated in a manner more suitable for an adjacent zone and/or formation.

Another disadvantage in conventional systems regards the deployment of sensitive transmission lines outside the casing. It is often desirable to deploy a cable, fiber or tube along the length of a wellbore for connection to, or to act directly as, a sensing device. Where such a device is deployed outside a casing and where that casing is subsequently perforated, there exists a substantial risk that the device will be damaged by being directly impinged upon by the jet created by an exploding charge because the cables are not fixed at a known location to prevent being hit by the charge. This risk is elevated if the perforating system is difficult to orient within the wellbore. Thus, there is a need in the prior art for a method of protecting these sensitive transmission lines during perforation.

Thus, a need exists for (i) a modular perforation assembly which is conveyed by the casing as it is lowered within the wellbore so that it eliminates the need to run perforating equipment in and out of the well when completing multiple zones and/or formations; (ii) that the assembly be externally-mounted in such a way that the casing will be centered rather than offset within the wellbore upon its installation; (iii) that the assembly create perforations which are equally spaced and precise so that the perforated casing will have desirable in-flow characteristics and not be obstructed; (iv) that the charges of the assembly are fired from a plurality of points of origin about the periphery of the casing, but are limited in power so that they will penetrate the casing only once and will cause no damage to the rest of the casing; (v) that the perforations created do not significantly compromise the structural integrity of the casing; (vi) that the charges are fired in opposite directions so that different charges may be fired to rupture the casing wall while other more powerful charges are used to perforate the formation; (vii) a frame for the assembly that is easily constructed and will protectively maintain the charges on the outside of the casing in a dry and pressure-controlled environment; (viii) that the portions of the frame through which the charges are blasted into the formation be constructed of a less-damaging material than metal in order to minimize collateral formation damage that might be caused by the charges, and (ix) that a method be provided that enables perforation to be accomplished without damaging sensitive casing-conveyed transmission lines.

SUMMARY OF THE INVENTION

The present invention therefore, provides an apparatus for perforating a subterranean-earth formation through a wellbore lined with casing comprising i) a cylinder longitudinally secured on said casing, said cylinder having an inside surface, an outside surface, and two ends; ii) an end cap secured at each end of said cylinder fluidly isolating a chamber from all wellbore fluids, said chamber defined by said inside surface of said cylinder and said end cap; and iii) an explosive charge being disposed in each end of said chamber.

The present invention further provides a gun assembly for perforating a subterranean-earth formation through a wellbore lined with casing wherein said casing has inside and outside surfaces, comprising i) a first charge directed outward towards the formation to perforate the formation; and ii) a second charge directed inward towards the casing to perforate the casing.

The present invention further provides an apparatus for perforating a casing string comprising i) a first module and a second module, each first and second module comprising a gun assembly contained therein, the first module being positioned longitudinally adjacent the second module on the casing string; ii) a firing assembly for igniting the gun assembly in the first module; iii) a remote signaler to remotely detonate the firing assembly; and iv) a ballistic transfer assembly for igniting the gun assembly in the second module.

The present invention further provides an apparatus for perforating a subterranean-earth formation through the wellbore lined with casing comprising a plurality of chambers, each chamber containing a gun assembly therein, each gun assembly containing at least one explosive charge, said plurality of chambers disposed about the periphery of said casing such that said casing is substantially centered when introduced into and maintained in said wellbore.

The present invention further provides a method for perforating a subterranean-earth formation through a wellbore lined with casing, comprising the steps of i) attaching a plurality of explosive charges to an outside surface of said casing as said casing is run in the wellbore; ii) directing at least one of said plurality of explosive charges to perforate said casing and at least one of said plurality of explosive charges to perforate said formation; iii) positioning said plurality of explosive charges on said casing substantially adjacent a preferred zone within said formation to be perforated; and iv) detonating said plurality of explosive charges.

The present invention further provides a method for perforating a subterranean-earth formation through a wellbore lined with casing, comprising the steps of i) providing a plurality of gun assemblies; ii) disposing each of said gun assemblies in separate sealed chambers; iii) attaching each of said chambers on the exterior of the casing to form a number of longitudinal fins; and iv) using the longitudinal fins to center the casing within the wellbore when the casing is run down into the wellbore.

The present invention further provides an apparatus for perforating a subterranean-earth formation through a wellbore lined with casing, comprising i) a first module comprising a first gun assembly mounted on said casing at a first depth in the wellbore proximate a first zone of interest in said formation; and ii) a second module coupled with said first module, said second module comprising a second gun assembly mounted on said casing at a second depth in the wellbore proximate a second zone of interest in said formation.

The present invention further provides an apparatus for perforating a subterranean-earth formation through a wellbore lined with casing, comprising the steps of i) securing a first module comprising a first gun assembly at a first position on said casing; ii) securing a second module comprising a second gun assembly at a second position on said casing; iii) selecting said first position and said second position so that when said casing is positioned in said wellbore, said first module is proximate a first zone of interest in said formation and said second module is proximate a second zone of interest in said formation; iv) placing said casing in said wellbore; v) detonating said first gun assembly; and vi) detonating said second gun assembly by a ballistic transfer of energy from said first gun assembly.

The present invention further provides a firing assembly for activating a perforating device and perforating a subterranean-earth formation through a wellbore lined with casing, said perforating device comprising a module having a first chamber and a second chamber, said first chamber including a first gun assembly and said second chamber including a second gun assembly, said firing assembly comprising: i) a firing head for transferring ballistic energy to the perforating device, said firing head having a detonator and a plurality of ballistic charges, said detonator coupled to at least one of said first gun assembly and said firing head linking said first gun assembly to said second gun assembly; ii) a remote signaler for sending a detonation signal; and iii) a receiving device for receiving said detonation signal and activating said detonator, said detonator causing at least one of said plurality of ballistic charges to explode and detonate at least one of the first gun assembly and the second gun assembly.

The present invention further provides a carrier for a perforating device, the perforating device causing the perforation of a subterranean earth formation through a wellbore, the carrier comprising i) a clamp for securing the perforating device; and ii) a plurality of fasteners for securing the carrier to an object within the wellbore.

The present invention further provides an apparatus for perforating a subterranean earth formation through a wellbore, the apparatus comprising a carrier and a perforating device, the carrier comprising a plurality of fasteners for securing the carrier to an object within the wellbore.

The present invention further provides an apparatus for perforating a subterranean earth formation through a wellbore lined with casing, the apparatus comprising a gun assembly secured to an exterior surface of the casing, the gun assembly comprising a first charge and a second charge, the first charge being positioned to form a first opening in the formation for fluid communication between the wellbore and the formation, the second charge being positioned to form a second opening for fluid communication between the wellbore and an area inside the casing, the first opening defining a first flow path and the second opening defining a second flow path, the first flow path being substantially non-perpendicular to a plane that is substantially perpendicular to the second flow path.

BRIEF DESCRIPTION OF THE DRAWINGS

The invention will be described with reference to the accompanying drawings, in which like elements are referenced with like reference numerals, and in which.

DETAILED DESCRIPTION OF THE INVENTION

The present invention generally provides various apparatus and methods for externally perforating a wellbore casing and formation. The present invention relates to a casing conveyed perforating system attached to the outside of the casing and is conveyed along with the casing when it is inserted into the wellbore.

Figure 1:
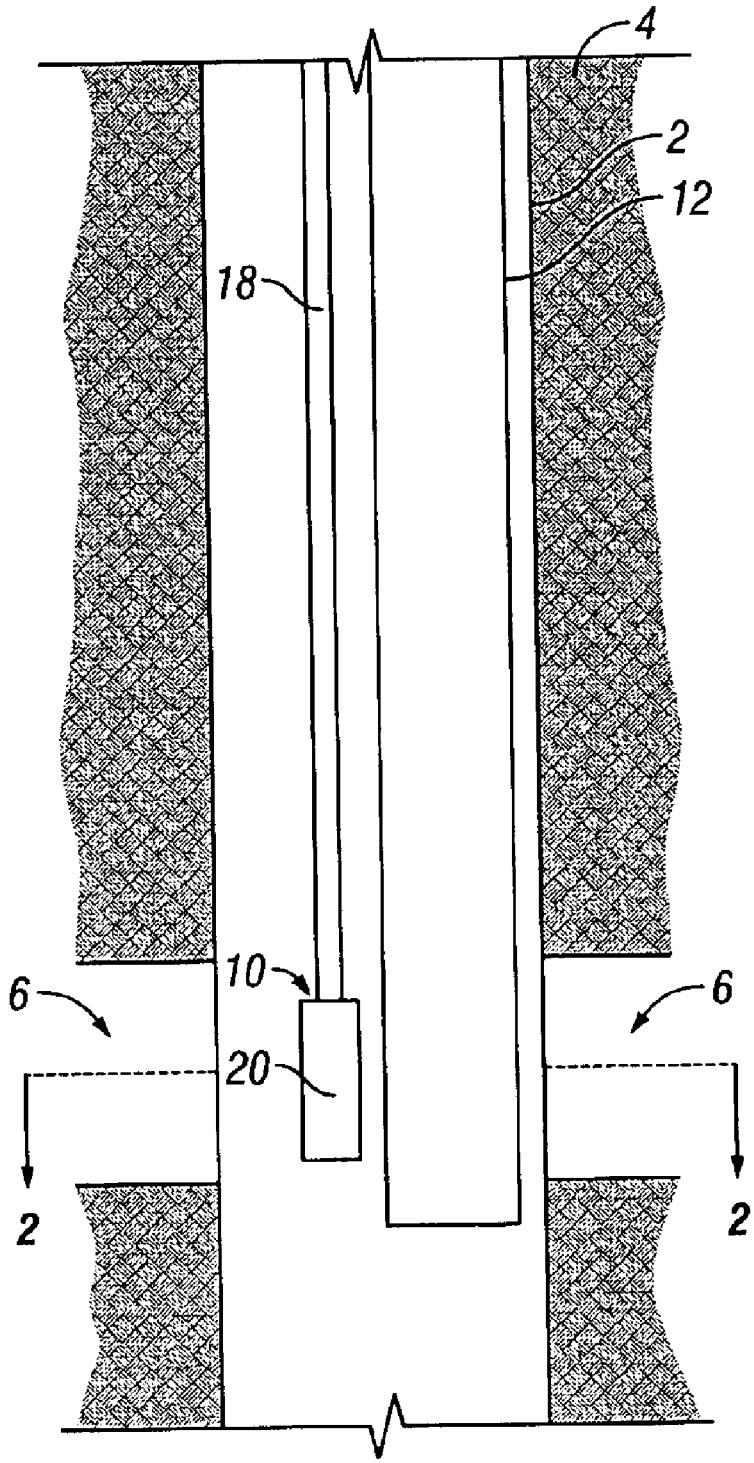
FIG. 1 (Prior Art)
FIG. 1 is a sectional side view of the Snider perforating gun assembly positioned in a subterranean wellbore.
Figure 3:
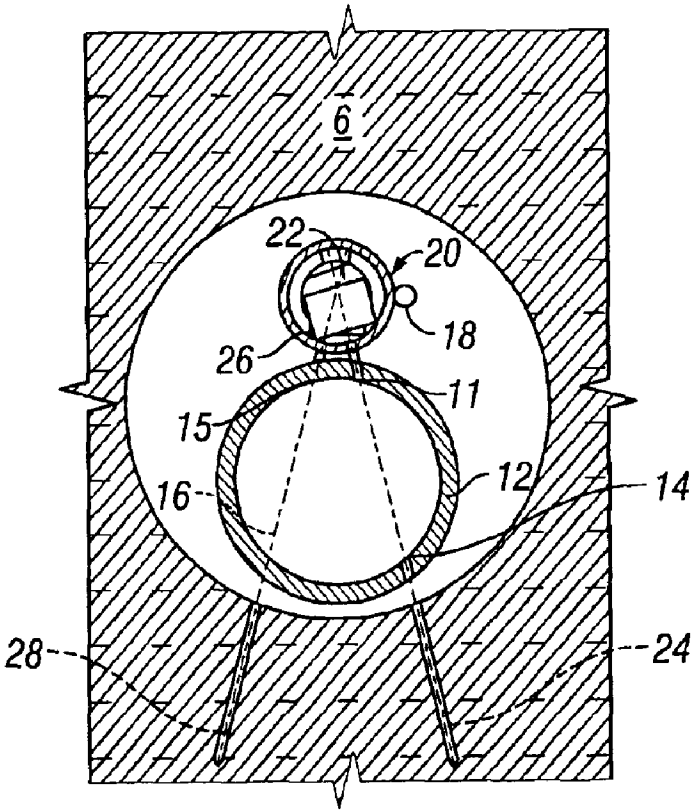
FIG. 3 (Prior Art)
FIG. 3 is a cross-sectional view of FIG. 1 along line 2—2 after the explosive charges are detonated.
Figure 2:
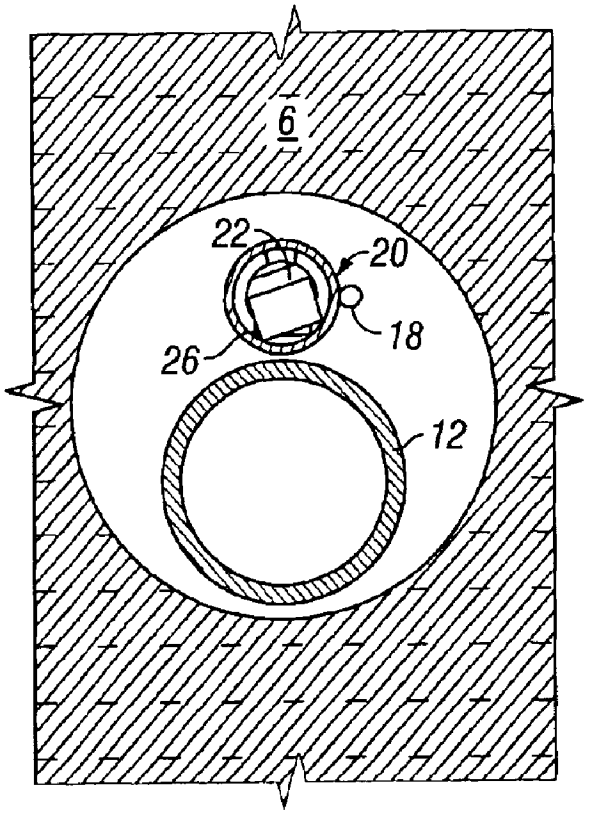
FIG. 2 (Prior Art)
FIG. 2 is a cross-sectional view of FIG. 1 along line 2—2 before the explosive charges are detonated.
Figure 4:
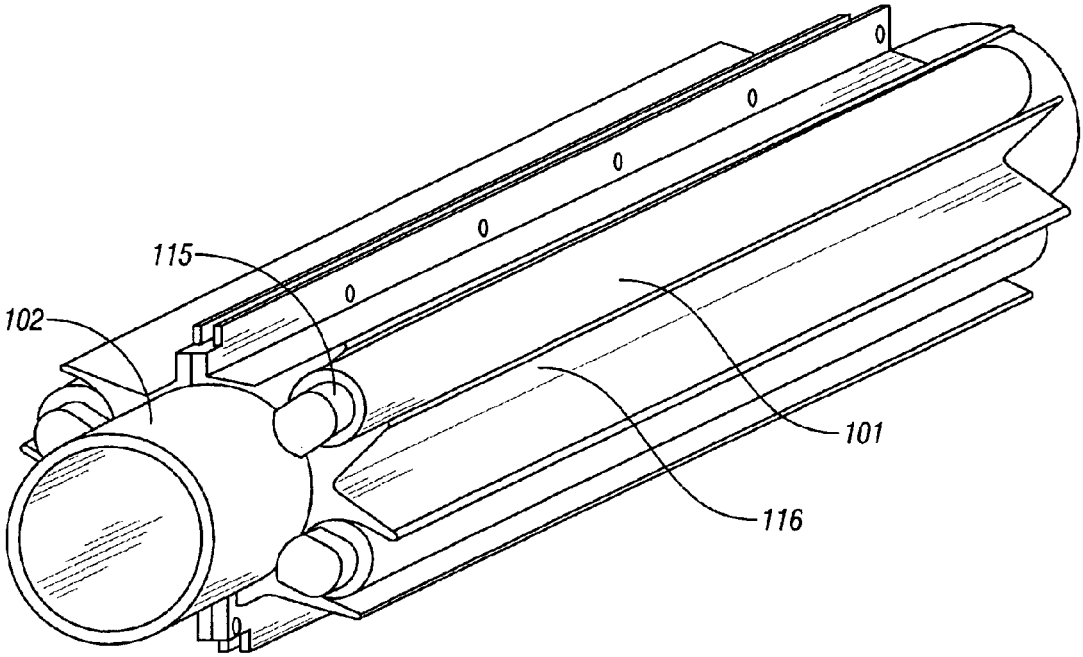
FIG. 4 is a perspective view of one embodiment of the present invention illustrating a carrier with multiple pressure chambers attached to a segment of casing.

Referring first to FIG. 4, the present invention comprises a plurality of pressure chambers 101, which are arranged radially around the outside of a wellbore casing 102. Each pressure chamber 101 is used to protect the relatively sensitive components contained therein.

The casing 102, which may comprise a number of casing segments, is run into the wellbore after it has been drilled in a manner known to those skilled in the art. Cement is then typically poured around the casing to fill in an annular space or gap between the casing 102 and the wellbore. Hydrostatic pressure created by any fluid in the wellbore, e.g., mud, brine, or wet cement, creates pressures that might damage gun components such as detonating equipment or charges. The pressure chamber 101 guards against such damage.

It is not necessary, however, that the present invention be used only in cemented completions. The present invention may also be used in applications where cement is not placed around the casing 102.

Regardless of the application, each pressure chamber 101 is a tubular vessel of constant internal diameter. The pressure chamber 101 is capable of withstanding external wellbore pressure while maintaining atmospheric pressure therein. Each pressure chamber 101 may be constructed of a material resistant to abrasion and impermeable to wellbore fluids. It may also be resistant to chemical degradation under prolonged exposure to wellbore fluids at bottom hole temperature and pressure. Each pressure chamber 101 may be either metallic or non-metallic in nature and sealed at both ends by end caps 115. Each pressure chamber 101 may be secured to maintain the orientation of its contents relative to a surface of the casing 102. It may also have an internal diameter not less than that required to accommodate one or more shaped charges 104 shown in FIG. 5.

Figure 9A:
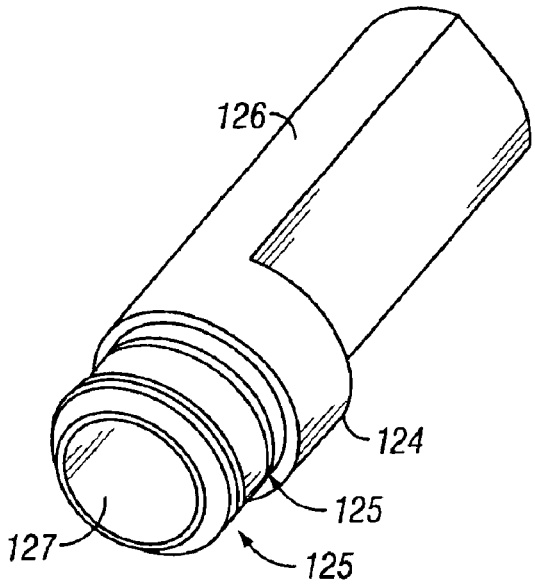
FIGS. 9A–D illustrate various views of an end cap of the present invention.
Figure 9B:
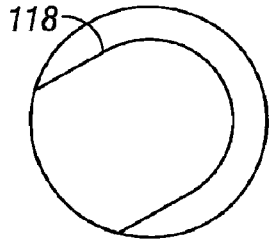
Figure 9C:
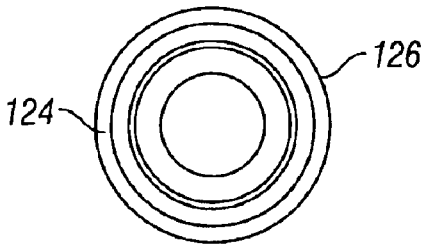
Figure 9D:
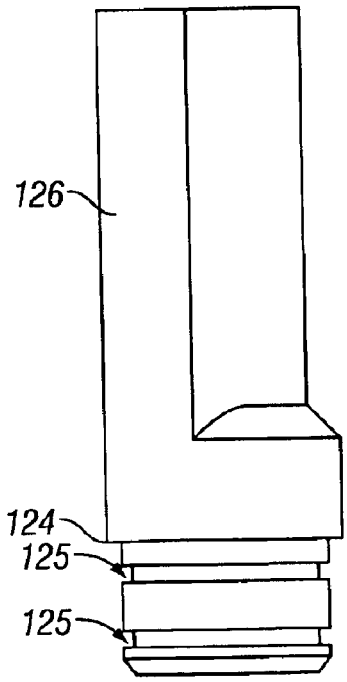

One embodiment of a pressure chamber 101 comprises a tube having a circular cross-section. The pressure chamber 101 may be manufactured with a composite material such as carbon fiber winding saturated with a thermoplastic resin. The pressure chamber 101 is held in position relative to the casing 102 by a carrier 116 and is secured in position by a clamp 117. The pressure chamber 101 is made stationary as a result of a square profile 118 on its end (FIG. 9B), and a matching profile 132 on clamp 117 (FIG. 12B). Alternatively, the pressure chamber 101 may be held in place by other conventional means such as set screws (not shown) that pass through the clamp 117 into grooves (not shown) on the end cap 115.

Each end cap 115 forms a plug to seal the end of the respective pressure chamber 101 as illustrated in FIGS. 9A–D. Each end cap 115 has a profile 124 (FIG. 9C) that allows its insertion to a fixed distance into the pressure chamber 101. Sealing elements 125, which may comprise O-rings, provide pressure isolation between the inside of the pressure chamber 101 and the wellbore environment. A profile 126 may also be provided to prevent rotation of the pressure chamber 101 relative to the casing 102. Each end cap 115 also has an internal bore 127 along its axis. Bore 127 does not extend entirely through the end cap 115, which enables ballistic transfer devices, referred to herein as a receiver charge 120 or a booster charge 121, to be fixed within the end cap 115. Each end cap 115 may be metallic or non-metallic in nature. Preferably, each end cap 115 may be constructed of composite materials. Composite articles, such as the pressure chamber 101 and end cap 115, may be supplied by Airborne Products, BV located in Leidschendam, Netherlands.

Figure 5:
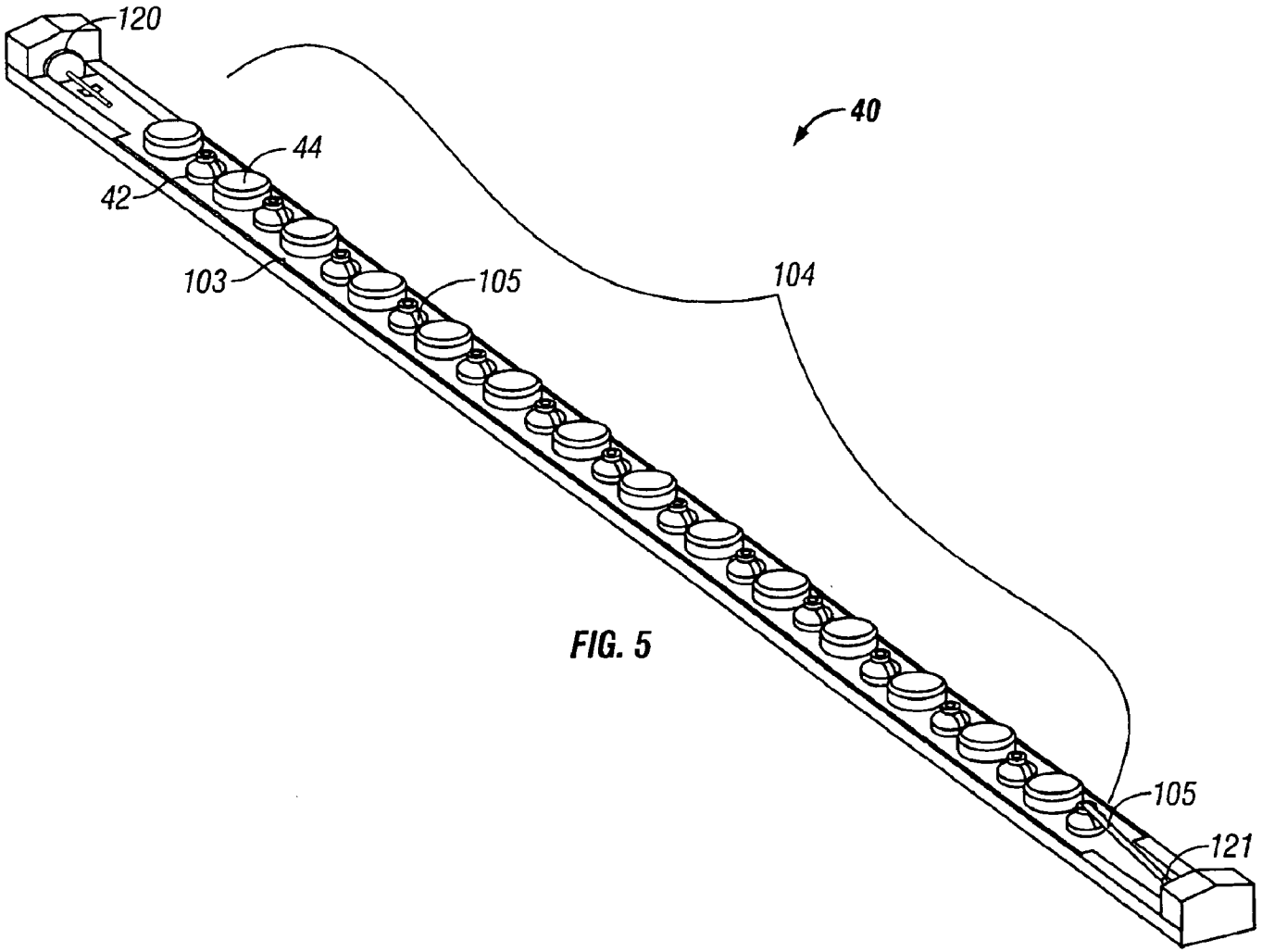
FIG. 5 is a perspective view of the present invention illustrating a perforating gun assembly.
Figure 8:
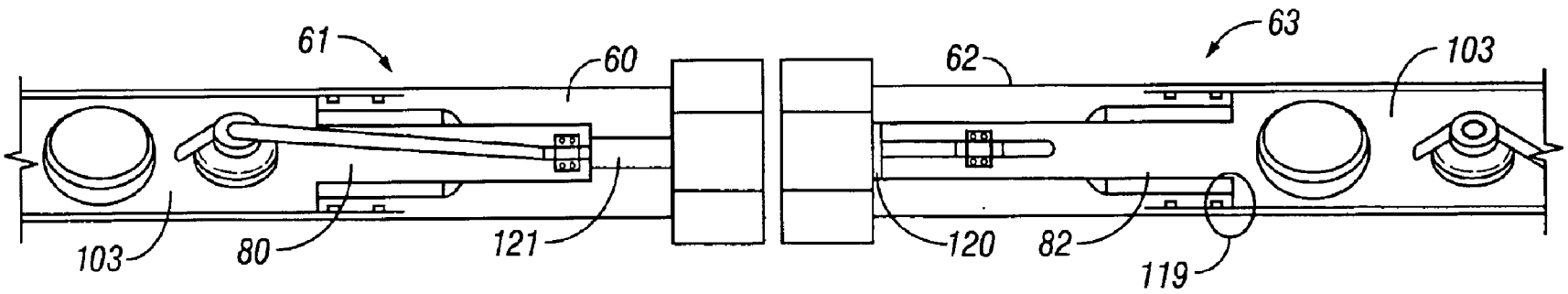
FIG. 8 is a partial top view of the present invention illustrating two perforating gun assemblies positioned end to end.

Inside each pressure chamber 101 is gun assembly 40 as shown in FIG. 5. The gun assembly 40 comprises a flat metal strip 103, which is typically used within hollow carrier perforating devices in the oilfield. As shown in FIG. 8, minimized portions 80, 82 of each strip 103 are received in each end cap 115. Slots 119 in each end cap 115 hold the strip 103 so that it does not rotate within the pressure chamber 101. Thus, strip 103 is secured within pressure chamber 101. Holes are machined into strip 103 so that it can accommodate the shaped charges 104. Slots are machined into strip 103 in order to accommodate the detonating cord 105, which is used to provide ballistic transfer between the shaped charges 104 and between the ballistic transfer devices 120 or 121 contained in each end cap 115.

The shaped charges 104 may be separated into two groups. A first group 42 are positioned to face the casing 102, and a second group 44 are positioned to face the formation. The charges in the two groups 42 and 44 are alternatively spaced. It is known that different types of charges are better for blasting into metal surfaces (such as casings) than other types of charges that are better for blasting into rock formations. Contrary to conventional perforation techniques that require the shaped charges to penetrate both the metallic casing and rock formations, the gun assembly 40 allows the use of different types of charges depending on the perforation requirements.

Charges such as those used here are typically metallic in nature, containing pressed explosives and a pressed metal or forged liner, creating a shaped explosive charge, as is typically used in oilfield perforating devices. When ignited, they will create a hole of specific dimensions through the material into which they are fired. These charges must be maintained in an environment of low humidity and at atmospheric pressure. This is accomplished by the pressure chamber 101, which protects the charges from subterranean fluids and the tremendous pressures encountered within the wellbore. The charges of the first group 42 will perforate through the pressure chamber 101, the carrier 116, and an adjacent wall of the casing 102. These shaped charges will not, however, damage in any way the wall of the casing 102 diametrically opposite from the point of perforation. The charges of the second group 44 will perforate through the pressure chamber 101 and through any surrounding cement sheath into the adjacent rock formation. This may be perpendicular or tangential to the surface of the casing 102, or form any other angle thereto.

Figure 10:
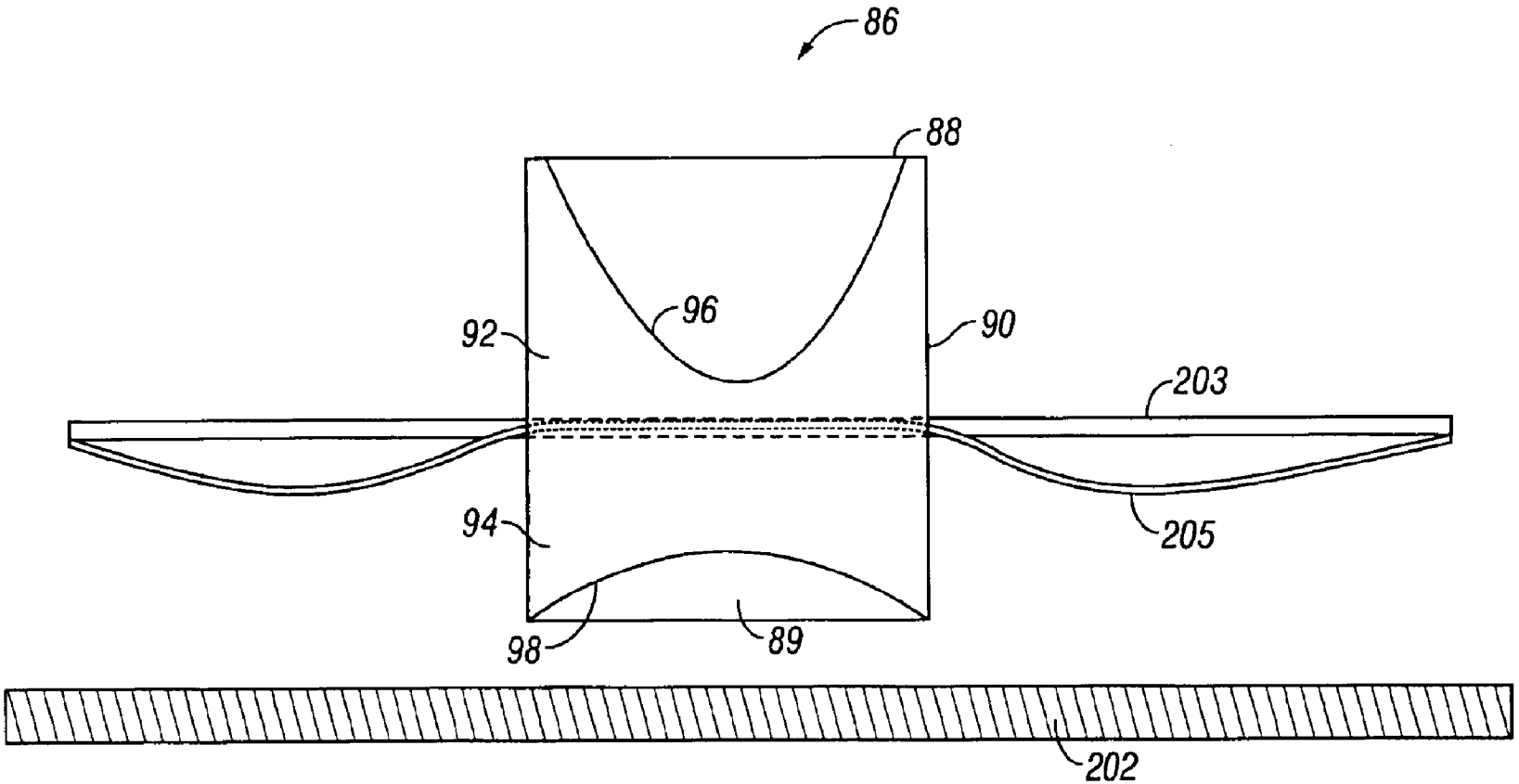
FIG. 10 is a side view of the present invention illustrating a bi-directional charge.

In another embodiment illustrated in FIG. 10, all of the shaped charges are bi-directional in nature, having both inward and outward-firing components so as to fire two separate shaped charges in opposite directions—simultaneously. For example, a bi-directional charge 86 is contained in a charge capsule 90. A first charge component 88 is aimed in the direction of the formation. A second charge component 89 is aimed at the casing 202. Both first and second charge components 88, 89 comprise pressed explosives that are contained within shaped liners 92 and 94, respectively. Liners 92 and 94 have liner profiles 96 and 98, respectively, that direct the explosive perforating jets emitted after detonation. The first charge component 88 is much larger than the second charge component 89 in order to maximize penetration into the formation using a larger charge component, while providing the minimum required explosive mass to satisfactorily penetrate the casing 202. Because much less penetrating force is necessary to pierce the casing 202, the second charge component 89 is much smaller. This limitation in the explosive force created also prevents damage of any kind to the wall of the casing 202 diametrically opposite from the point of perforation. The bi-directional charge 86 is arranged on a metal strip 203 in the same manner as the shaped charges 104 shown in FIG. 5. The bi-directional charge 86 is also connected to a detonating cord 205 in much the same way—except that the detonating cord 205 bisects liners 92 and 94. Bi-directional charges may be arranged in any pattern within the pressure chamber 101 and are maintained in an environment of low humidity and at atmospheric pressure by means of the pressure chamber 101. Like the embodiment shown in FIG. 5, the charges are maintained in ballistic connection by means of the detonating cord 205.

In either embodiment, the detonating cord 105 or 205 is used to ignite all of the charges used to perforate the casing and formation in response to an electrical charge. The detonating cord 105 or 205 may be any explosive detonating cord that is typically used in oilfield perforating operations (and other applications such as mining) and may comprise an RDX or HMX explosive within a protective coating. The type of cord chosen should also have the capability to provide ballistic transfer between an electronic detonator and a ballistic transfer device, between ballistic transfer devices, and between ballistic transfer devices and shaped charges.

Figure 6B:
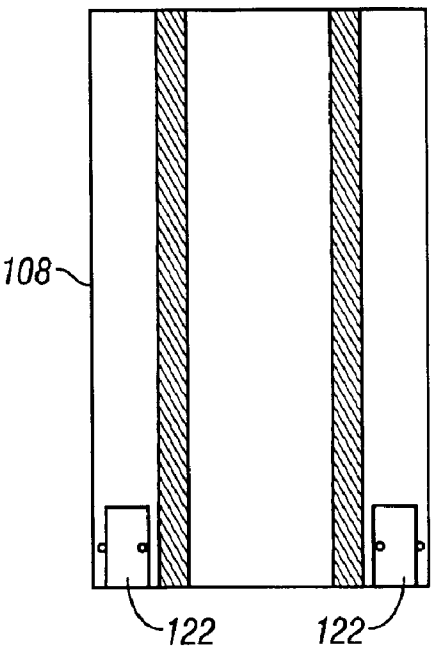
FIG. 6B is a partial cross-section of FIG. 6A along line 6B—6B illustrating inserted nipples that each carry a donor charge.
Figure 6A:
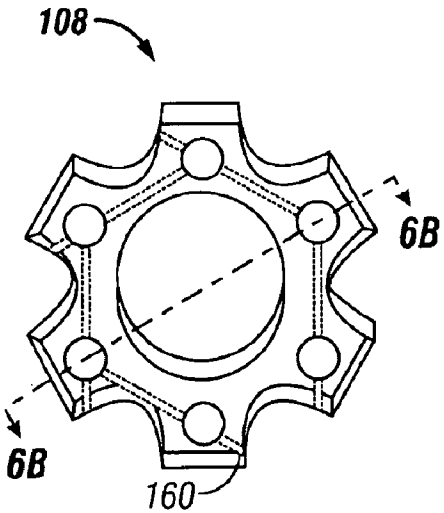
FIG. 6A is a cut view of the present invention illustrating the firing head.

Referring now to FIGS. 6A and 6B, a firing head 108 is provided, in one respect, to secure each pressure chamber 101 surrounding the casing 102. The firing head 108 is also used to detonate a booster charge 121 in each pressure chamber 101. The firing head 108 is a machined body that fits around the outside of the casing 102. The firing head 108 includes ports 160, fittings, and receptacles (not shown), which allow the installation of electrical devices within each pressure chamber 101 while providing requisite electrical and ballistic connections to the outside of each pressure chamber 101. The firing head 108 also includes a nipple 122 for each adjacent and longitudinally aligned pressure chamber 101. Each nipple 122 contains a ballistic transfer device (donor charge 104A in FIG. 7) for activating the booster charge 121. The firing head 108 may be secured to the casing 102 by any known means, such as grub screws, so that it cannot rotate or move laterally along the casing 102. The firing head 108 is normally metallic in nature and has a number of connection points for the admission of signals from a telemetry device at the surface of the formation.

The firing head 108 is controlled using a telemetry system. The telemetry system may comprise any known transmission means for transmitting signals from a control station outside the wellbore (not shown) to the electronic devices located in the firing head 108 and vice versa. The transmission means may accommodate signals that are electronic, electromagnetic, acoustic, seismic, hydraulic, optical, radio or otherwise in nature. The transmission means may comprise, for example, a device providing a continuous connection between the firing head 108 and the wellhead such as a cable 108A, a hydraulic control line, optical fiber, or the casing 102. The telemetry system also comprises a feed-through device (not shown) to allow the transmission means (cable 108A) to pass through the wellhead without creating a leak path for wellbore fluids under pressure. The cable 108A may be secured to the outside of the casing 102 to prevent damage while running the casing 102 in the wellbore.

A non-continuous transmission means for transmitting the detonating signals may also be used between modular applications of the present invention positioned longitudinally along the casing 102. For example, a non-electric detonating train comprising Nonal, or an equivalent material, may be used to initiate the detonation signal. The use of electrical or other continuous transmission means to detonate the shaped charges positioned in the several modular applications of the present invention (or to "back-up" a continuous transmission means) may result in a short-circuit caused by wellbore fluids thus, terminating any further detonation of the shaped charges. Thus, the use of a non-continuous transmission means to conduct the detonation process means that ingress from the wellbore fluids between modular applications of the present invention are non-terminal.

Regardless of whether continuous or non-continuous means are used for signal transmission, the telemetry system transmits signals at a power level that is insufficient to cause detonation of the detonating device or shaped charges.

Figure 7:
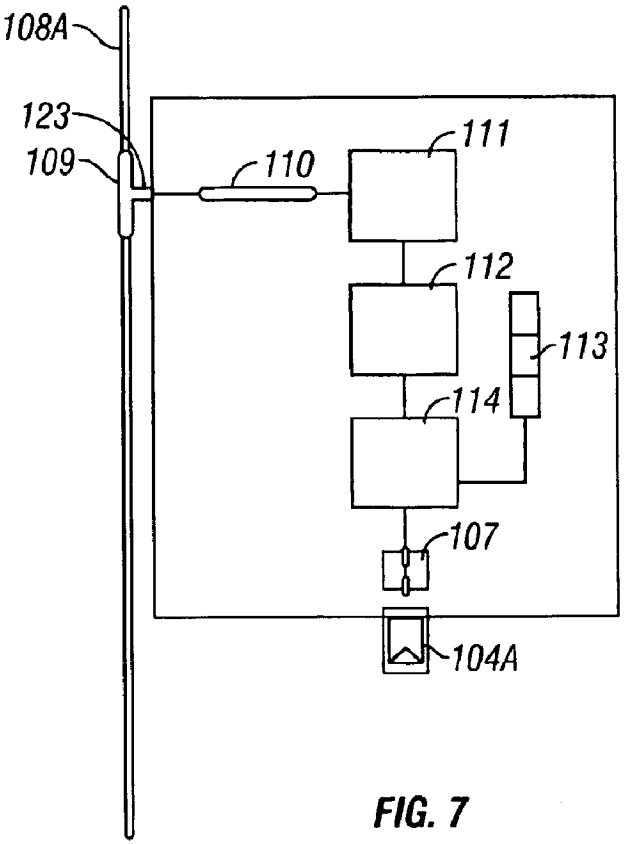
FIG. 7 is a schematic diagram illustrating the electrical components of the firing head.

A schematic diagram showing the electronic components of firing head 108 is provided in FIG. 7. The signal from the control station at the surface is transmitted, for example, through the cable 108A, an electrical connector 109 and an electronic connection point 123 to the firing head 108.

Electrical connector 109 is a device through which signals are transmitted to the connection point 123 and other electronic components within the firing head 108. The electrical connector 109 has at least two coaxial conductors and two or three terminations, forming either an elbow or T-piece configuration. The electrical connector 109 also provides continuity to each of the at least two conductors and each of the two or three termination points. The body of electrical connector 109 may be metallic or non-metallic in nature, being typically either steel or a durable composite (e.g., the composite known as "PEEK").

Besides electrical connector 109, other electronic components include a transmitter/receiver 111 for transmitting or receiving a signal to or from the surface, and an isolating device 110 to prevent short-circuit of the transmitter/receiver 111 after detonation of the firing head 108.

The isolating device 110 is used to isolate the electrical connector 109 to which it is attached, from any invasion of conductive fluids so that electrical continuity at and beyond the electrical connector 109 is maintained even though conductive fluids may have caused a short circuit at the isolating device 110. For example, electrical continuity through the transmitter/receiver 111 is maintained after detonation of the firing head 108 because the isolating device 110 prevents wellbore fluids from entering the firing head 108 and reaching the other electronic components within the firing head 108. Isolating device 110, and other devices used for similar purposes, are generally known in the art and commercially available.

An electronic processing device 112 is also provided. The processing device 112 is used to interpret signals from the surface and then transmit signals back to the surface. The signals are recognized by the processing device 112 as matching a pre-programmed specification corresponding to a command to execute some pre-determined action. The processing device 112 comprises a microprocessor-based electronic circuit capable of discriminating with extremely high reliability between signals purposefully transmitted to it through the transmitter/receiver 111 and stray signals received from some other source. The processing device 112 is also capable of interpreting such signals as one or more instructions to carry out pre-determined actions. The processing device 112 contains known internal devices that physically interrupt electrical continuity unless predetermined conditions are met. These internal devices may include a temperature switch, a pressure switch, or a timer. Once a particular condition is satisfied (e.g., a particular temperature, pressure, or the elapse of time) the internal device creates electrical continuity. Once continuity is achieved, the resulting electrical connection is used to initiate one or more pre-determined actions. These actions may include (i) initiating the firing of an electronic detonating device 107 via an electronic high-voltage device 114; (ii) the transmission of a coded signal back to the transmitter/receiver 111, the nature of which may be determined by the state of one or more variable characteristics inherent to the processing device 112; and/or (iii) the execution of an irreversible action such that the processing device 112 and/or high-voltage device 114 are rendered incapable of activating the detonating device 107. One embodiment of the processing device 112 is manufactured by Nan Gall Technology Inc. and can be easily modified to perform in the manner described above, such modifications being well within the knowledge of one skilled in the art.

The source of voltage necessary for activation of the detonating device 107 is drawn from a power source 113. Power source 113 comprises one or more electrical batteries capable of providing sufficient power to allow the electronic devices within the firing head 108 to function for the designed life of the system. The battery or batteries selected may comprise any number of known types (e.g., lithium or alkaline) and may be rechargeable, in a trickle-charge manner, via the transmitter/receiver 111.

The high-voltage device 114 is used to transform the low voltage supply provided by power source 113 (typically less than 10 volts) into a high-voltage spike (typically of the order 1000V, 200 A), within a few microseconds as appropriate for activation of the detonating device 107. Such a device is known to those skilled in the art as a "fireset" or "detonating set." The high-voltage device 114 is commercially available from Ecosse Inc.

The detonating device 107 is activated when the appropriate signals are transferred to the firing head 108 through electrical connector 109. After the processing device 112 interprets the detonation signals, a charge from the power source 113 is transmitted through the high-voltage device 114 to the detonating device 107.

Upon activation, the detonating device 107 generates a shock wave, on application of electrical voltage, of an appropriate waveform. The detonating device 107 typically comprises a wire or filament of known dimensions, which flash vaporizes upon application of sufficient voltage. One example of a detonator that may be used is referred to by those skilled in the art as an exploding bridge wire (EBW) detonator. Such detonators are typically packaged together with an electronic high-voltage device. Other kinds of detonators known to those skilled in the art may also be used.

The shaped charges 104 in each pressure chamber 101 may be detonated using a single detonating device 107 and a detonating cord similar to detonating cord 105. For example, the detonating device 107 activates a donor charge 104A that communicates with a detonating cord (not shown). The detonating cord is passed through ports 160 of the firing head 108 illustrated in FIG. 6A and communicates with a donor charge positioned in each respective nipple 122 of the firing head 108 illustrated in FIG. 6B. Thus, activation of the donor charge 104A detonates each donor charge in communication with the detonating cord. Ballistic transfer is then used to fire each pressure chamber 101 at the same depth or at different depths within the wellbore.

Referring now to FIG. 8, a first (upper) gun assembly 61 is in shock-wave communication with a second (lower) gun assembly 63. A receiver charge (not shown) positioned at the upper end of the first gun assembly 61 is activated by ballistic transfer of a shock wave from the explosion of a donor charge located adjacent the receiver charge in the nipple 122 of the firing head 108. Thus, the end cap 115 of each pressure chamber 101 is aligned with a corresponding nipple 122 of the firing head 108 in order to maintain a distance capable of ballistic transfer. Once the receiver charge is detonated in the pressure chamber containing the first gun assembly 61, the shaped charges 104 in FIG. 6 are detonated as the charge passes through the detonating cord 105 to the booster charge 121. The booster charge 121 at the lower end 60 of the first gun assembly 61 is axially aligned and separated by a known distance from an upper end 62 of the second gun assembly 63 containing a receiver charge 120. The axis of the gun assemblies 61 and 63 may be aligned so that the shock wave generated by the ignition of the first gun assembly 61 is transferred from the booster charge 121 to the receiver charge 120 in the second gun assembly 63. The use of booster charges and receiver charges in successive pressure chambers may be used to reliably allow the continued propagation of the detonation shock wave from the firing head 108 to an adjacent pressure chamber.

Figure 11A:
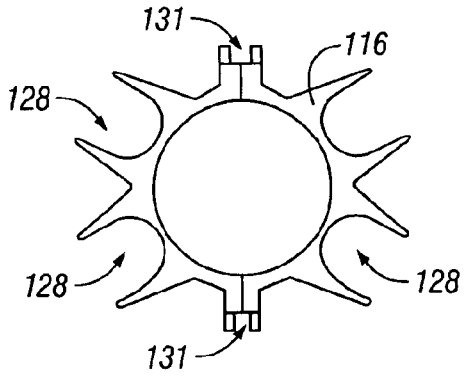
FIG. 11A is an end view of the carrier illustrated in FIG. 4 without pressure chambers.
Figure 11B:
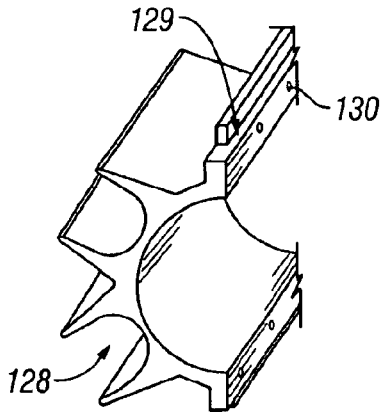
FIG. 11B is a partial perspective view of half of the carrier illustrated in FIG. 11A.

Referring now to FIGS. 11A and 11B, the carrier 116 is shown without the attached pressure chambers. Pre-formed channels 128 on the exterior of carrier 116 receive the tubular pressure chambers. Each carrier 116 comprises two hemi-cylindrical parts, like the one illustrated in FIG. 11B. Each half of the carrier is secured to the other half by bolts (not shown) that pass through bolt holes 130. Each half of the carrier 116 includes profiles 129 formed at either end to accommodate clamps 117, which are illustrated in FIG. 12. Once the carrier 116 is secured to the casing, a plurality of longitudinal canals 131 are defined by the structure of the carrier 116. The canals 131 create a protective space in which a continuous transmission medium, such as cable, control line or fiber optics, can be deployed. It is often desirable to deploy a cable or fiber optics along the length of a wellbore for connection to, or to act directly as, a sensing device. By deploying such items in the canals 131, they are kept away from any damage potentially caused by detonation of the shaped charges facing the casing or formation.

The carrier 116 may be constructed of metallic or non-metallic materials. The material used in the preferred embodiment is aluminum. The length of the carrier 116 is equal to that of the pressure chamber 101 and each end cap 115, allowing for a pre-determined separation between the end cap of one pressure chamber and the end cap of another pressure chamber mounted above or below it on the casing.

Figure 12A:
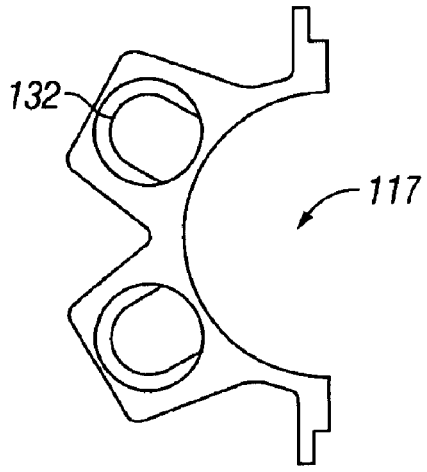
FIG. 12A is an end view of a clamp used to secure the carrier to the casing.
Figure 12B:
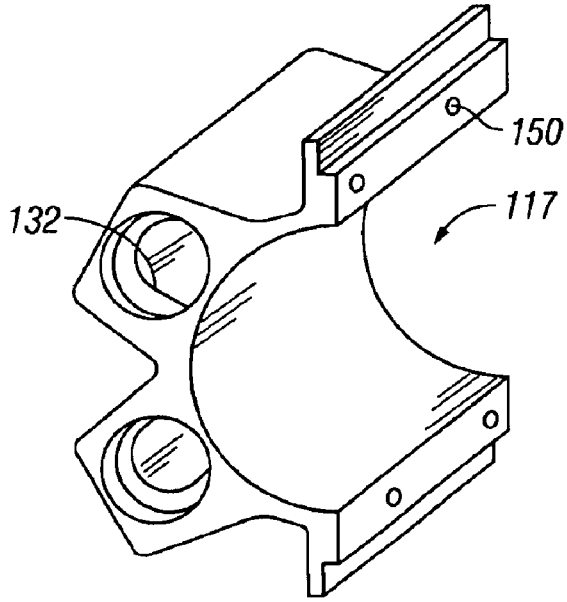
FIG. 12B is a perspective view of the clamp illustrated in FIG. 12A.

As shown in FIG. 12A and 12B, a pre-formed clamp is used for securing the carrier 116 and pressure chambers to the casing 102. Like the carrier 116, the clamp comprises two hemi-cylindrical parts like the one (117) illustrated in FIG. 12A. Each half of the clamp 117 is secured to the other half by bolts (not shown) that pass through bolt holes 150. The outer diameter of each half of the clamp 117, once made up on the casing 102, should be no greater than the outer diameter of the carrier 116.

The embodiments thus described, enable efficient and safe installation of the casing conveyed well perforating apparatus. First, the components are easily installed on the outside of the casing 102 as described above. Then the entire casing 102 is run in the wellbore. The present invention, therefore, is modular so that a large number of modules may be connected end to end, with ballistic transfer arranged from one module to the next module for perforation of long casing intervals. For shorter intervals, fewer modules may be used.

As these modules are run into the wellbore, the centralizing function of a modular perforating assembly is realized. Because the firing head 108, carrier 116 and pressure chambers 101 are equidistantly spaced and extend radially from the casing 102, the casing 102 may be centered within the wellbore. In other words, the modular assembly of one embodiment of the present invention is self-aligning as it is inserted into the wellbore. Because the casing 102 is centralized and not offset like conventional external perforating assemblies and/or insertion methods, the annular space between casing 102 and the wellbore is minimized. This minimization of annular space afforded by the present invention will either minimize wellbore diameters, maximize casing diameters, or both—resulting in reduced costs and increased productivity.

Once the casing 102 is properly positioned within the wellbore, cement is circulated into the annular space between the casing 102 and the wellbore by means generally well known to those skilled in the art. The cement circulates freely through the space between the channels 128 separating each pressure chamber 101. Although circulation is not impaired by this embodiment, it could, however, be enhanced by a helical embodiment.

If the carrier 116 was formed in a helical shape, instead of longitudinally, as shown in FIGS. 4–12, it may induce turbulence when the cement is circulated through the space between the channels 128. Turbulence created by the circulating cement forces mud and other substances to the surface where they are preferably removed. Otherwise, when the cement hardens, the mud that has not been displaced will inhibit the formation of a seal between the casing 102 and the formation. Therefore, a carrier 116 and associated components forming a helical design may enhance the desired sealing properties of the cement.

Additionally, either design (longitudinal or helical) inherently reduces the amount of annular space between the casing 102 and the wellbore thus, placing the carrier 116 in closer proximity to the formation. Because this arrangement of charges requires less annular space between the casing 102 and the wellbore, less cement is required thus, further reducing costs. As a result, smaller charges are needed to perforate though the cement into the formation.

Additionally, once installed, each gun assembly 40 may be fired in any order. This is a significant advantage over the Snider system, which requires a bottom to top firing sequence. This is necessary because, with the Snider system, continuity is destroyed when the tool is activated. Such is not the case with the present invention, however. Because the modules of the present invention may be fired in any order, the user is able to access multiple formation zones during the life of the well. The result is increased productivity.

Of course, alternative embodiments not specifically identified above, but still falling within the scope of the present invention exist. For example, the pressure chamber 101 and carrier 116 may be formed as one integral component Additionally, injection molding could be used to form the pressure chamber 101 and the carrier 116, while maintaining the features and functions described above. Resin transfer molding could also be used for the same purpose, as could any other comparable process for manufacturing solid bodies. Attaching the components housed in each pressure chamber 101 directly to the casing 102 could also be employed. For example, epoxy resin, or other similar material that cures into a hard solid, may be poured over and around such components within a pre-formed mold and attached to the casing 102 by means of any well-known industrial adhesive.

It is also possible that the present invention could be used equally well when the casing 102 is not secured by cement within the wellbore. When drilling certain hydrocarbon bearing formations, the invasion of drilling fluids into the formation causes significant damage to the near-wellbore region, impairing productivity. In situations where cementing and perforating the casing are undesirable, various means are used to avoid and/or remove such damage. For example, a pre-drilled or slotted liner may often be run in the wellbore to preserve its geometry and/or prevent ingress of formation material. The present invention provides a cost-effective way to bypass the damaged zone and perforate the desired formation without the use of cement.

Although the invention has been described with reference to the preferred embodiments illustrated in the attached drawing figures, and described above, it is noted that substitutions may be made and equivalents employed herein without departing from the scope of the invention.

What the invention claimed is:

1. An apparatus for perforating a subterranean earth formation through a wellbore lined with casing comprising:

a cylinder longitudinally secured on said casing, said cylinder having an inside surface, an outside surface, and two ends;

an end cap secured at each end of said cylinder fluidly isolating a chamber from all wellbore fluids, said chamber defined by said inside surface of said cylinder and said end caps;

a first explosive charge being disposed in said chamber, said first charge being oriented toward said casing; and a second explosive charge being disposed in said chamber, said second charge being oriented toward said formation, wherein said first and second charges are contained within a single charge capsule.

2. The apparatus of claim 1, further comprising:

a carrier having at least one U-shaped channel defined thereby, said U-shaped channel adapted to receive said cylinder therein;

a pair of clamps, each of said clamps having a profile adapted to receive and hold a mating profile on each of said end caps.

3. The apparatus of claim 2 wherein portions of each of said profile of said clamp and mating profile on each of said end caps have substantially flat portions which engage each other to prevent the rotation of said cylinder within said carrier.

4. The apparatus of claim 2 wherein at least one of the cylinder, end caps, carrier, and clamps are at least partially constructed of composite materials.

5. An apparatus for perforating a subterranean earth formation through a wellbore lined with casing using a plurality of explosive charges, comprising:

a plurality of hollow cylinders, each having an inside surface, an outside surface, and two ends;

an end cap secured at each end of each of said plurality of cylinders, said end caps fluidly isolating each of said cylinders to define a chamber from all wellbore fluids therein, said chamber in each defined by said inside surface of said cylinder and said end caps;

at least one charge being disposed in each of said chambers;

a carrier attached to said casing having first and second halves, each of said halves having at least one longitudinally running U-shaped channel defined thereon, said at least one U-shaped channel of said first half adapted to receive said at least one of said plurality of cylinders therein, said at least one U-shaped channel of said second half adapted to receive at least one other of said plurality of cylinders therein; and a clamp at each end of said carrier adapted to receive said each of said end caps, and hold said plurality of cylinders in said U-shaped channels.

6. The apparatus of claim 5 wherein each of said first and second halves of said carrier have first and second transverse edges, said first and second halves being adapted to be coaxially secured around the outside surface of said casing when a flange on said first edge on said first half is fixed to a flange on said first edge on said second half by at least one fastener and a flange on said second edge on said first half is fixed to a flange on said second edge on said second half by at least one additional fastener.

7. The apparatus of claim 6 wherein at least one pair of flanges fixed together define there between a longitudinal canal which is used as a protective space in which a continuous medium may be deployed without being vulnerable to damage when said at least one charge is detonated.

8. A gun assembly used for perforating a subterranean earth formation through a wellbore lined with casing wherein said casing has inside and outside surfaces, comprising:

a first charge directed outward towards the formation to perforate the formation; and a second charge directed inward towards the casing to perforate the casing, wherein said first and second charges are contained within a single charge capsule.

9. The gun assembly of claim 8, wherein the first charge has sufficient explosive charge to enable it to sufficiently penetrate the formation, while the second charge has sufficient explosive charge to perforate the casing, but not so much that collateral damage is caused to untargeted portions of the casing.

10. The gun assembly of claim 8, wherein the first and second charges are fluidly isolated from wellbore fluids by being included in a protective chamber, said chamber being defined by a module comprising:

a hollow cylinder secured to said casing, said cylinder having an inside surface, an outside surface, and two ends;

an end cap secured at each end of said cylinder;

said protective chamber being defined by said inside surface of said cylinder and said end caps.

11. The gun assembly of claim 10, wherein the module maintains said first and second charges in close proximity to said outer surface of said casing.

12. A method of perforating a subterranean earth formation through a wellbore lined with casing, comprising the steps of:

attaching a plurality of explosive charges to an outside surface of said casing as said casing is run in the wellbore, wherein said explosive charges are comprised of opposing charges in a single charge capsule;

directing at least one of said plurality of explosive charges to perforate said casing and at least one of said plurality of explosive charges to perforate said formation;

positioning said plurality of explosive charges on said casing substantially adjacent a preferred zone within said formation to be perforated; and detonating said plurality of explosive charges.

13. The method of claim 12, wherein said plurality of explosive charges are detonated by a signal transmitted from a surface of said formation.

14. The method of claim 13, wherein said signal is transmitted using a telemetry system.

* * * * *